US007630656B2

(12) United States Patent
Endou et al.

(10) Patent No.: US 7,630,656 B2
(45) Date of Patent: Dec. 8, 2009

(54) IMAGE FORMING APPARATUS

(75) Inventors: Hirohisa Endou, Osaka (JP); Eiji Nimura, Osaka (JP); Shingo Sakato, Osaka (JP); Toyotsune Inoue, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 203 days.

(21) Appl. No.: 12/001,888

(22) Filed: Dec. 12, 2007

(65) Prior Publication Data

US 2008/0152366 A1 Jun. 26, 2008

(30) Foreign Application Priority Data

Dec. 22, 2006 (JP) ..... 2006-345982

(51) Int. Cl.
*G03G 15/08* (2006.01)
*G03G 15/00* (2006.01)

(52) U.S. Cl. ..... 399/29; 399/27; 399/43; 399/236; 399/257; 399/53

(58) Field of Classification Search ..... 399/27, 399/29, 236, 257
See application file for complete search history.

(56) References Cited

U.S. PATENT DOCUMENTS

2005/0025506 A1 * 2/2005 Adachi ..... 399/27

FOREIGN PATENT DOCUMENTS

JP 4-068370 3/1992

* cited by examiner

*Primary Examiner*—David M Gray
*Assistant Examiner*—Rodney Bonnette
(74) *Attorney, Agent, or Firm*—Jordan and Hamburg LLP

(57) ABSTRACT

To provide an image forming device that is capable of preventing deterioration of the image quality through preventing deterioration of the toner even if frequency of making a copy is low. The image forming device includes: a developing part having a developing roller for achieving development by electrostatically attaching a toner onto an electrostatic latent image formed on a photoreceptor; a transferring part for transferring a developed toner image to a paper; and a cleaner part for removing and collecting the toner remained on the photoreceptor after transferring, wherein the developing roller is rotary-driven at a lower speed than a speed of development under a standby state. The image forming device includes a standby-state refresh control part for forcibly consuming an amount of the toner that is calculated based on accumulated time of the low-speed rotary drive.

6 Claims, 13 Drawing Sheets

| Counter value | Consumed toner amount (g) | Toner consumption processing execution time (s) |
|---|---|---|
| 2 hrs > | 2 | 2 |
| 2 hrs ≤ and < 4 hrs | 4 | 4 |
| 4 hrs ≤ and < 6 hrs | 6 | 6 |
| 6 hrs ≤ and < 8 hrs | 8 | 8 |
| 8hrs ≤ | 10 | 10 |

Fig.5

| Printing ratio (%) | Consumed toner amount (g) | Toner consumption processing execution time (s) |
|---|---|---|
| 0 ≤ and < 0.5 | 15 | 15 |
| 0.5 ≤ and < 1 | 13 | 12.9 |
| 1 ≤ and < 2 | 11 | 10.5 |
| 2 ≤ and < 3 | 5 | 5.2 |
| 3 ≤ | 0 | |

Fig.13

IMAGE FORMING APPARATUS

This application is based on an application No. 2006-345982 filed in Japan, the contents of which are hereby incorporated by reference.

BACKGROUND OF THE INVENTION

1. Field of the Invention

The present invention relates to an electrophotographic-type image forming device such as a copying machine, a printer, or the like.

2. Description of the Related Art

In an electrophotographic-type image forming device, an image forming process for developing an electrostatic latent image is executed through corona-charging a photoreceptor as a latent image carrier by using a charging member to uniformly charge a surface of the photoreceptor, a surface of the photoreceptor is then exposed by an exposing part based on image data, and attaching a developer on the surface of the photoreceptor on which the electrostatic latent image is formed.

The developer is constituted with two components, a toner and a carrier, and it is filled inside a developing processor. A stirring mechanism for stirring the developer and a developing roller for supplying the developer to the photoreceptor are provided inside the developing processor. Through stirring the developer by the stirring mechanism, the toner and the carrier are frictionally charged, and the charged toner is supplied to the developing roller. The developer is constantly stirred while forming an image.

That is, the image forming device achieves a developing process by having the charged toner attached to the surface of the photoreceptor from the developing roller.

However, if an image forming process is executed repeatedly based on image data of a low printing ratio, the toner within the developing processor is not consumed so much that the same toner is continuously and repeatedly stirred, since an amount of the toner attached to the photoreceptor from the developing processor is small.

Therefore, the toner stirred continuously within the developing processor is overcharged because of frictions, and the toner is rubbed against an inner wall of the developing processor due to the stirring and it turns into fine particles. As a result, the quality of images may be deteriorated.

Therefore, as disclosed in Japanese Unexamined Patent Publication No. H04-68370, there is a technique proposed for forcibly consuming a developer through forcibly attaching the developer to a photoreceptor surface at a timing where printing based on image data is not carried out, and removing the developer attached to the photoreceptor without transferring the developer to a paper when a printing ratio of the image data is smaller than a prescribed reference value that is set in advance.

By the way, when amorphous silicon whose charge characteristic fluctuates depending on environments such as temperatures, humidity, and the like is employed as the photoreceptor, a heater is provided inside the photoreceptor for keeping the photoreceptor to a prescribed temperature so as to prevent a phenomenon of so-called image deletion where an image becomes blurred or deleted fuzzily.

Normally, the developing roller is disposed near the photoreceptor for splashing the toner onto the photoreceptor. Therefore, when such photoreceptor is employed, a part of the developing roller that is stopped during a standby state, which faces towards the photoreceptor side, becomes heated. This generates heat distortion causing the developing roller to have a partial thermal expansion. In an image formed under such condition, image unevenness is generated at a pitch of the circumference of the developing roller.

Therefore, in the image forming device that employs the amorphous silicon for the photoreceptor, in order to prevent generation of the unevenness at such pitch, the developing roller is normally rotary-driven at a low speed continuously or intermittently so as to prevent generation of the heat distortion due to the partial thermal expansion of the developing roller even under a standby state where the device is stopped.

However, if the low-speed rotary drive of the developing roller is continued for a long time, the toner inside the developing processor becomes overcharged due to frictions with the developing roller, and it is deteriorated as in the above-described case where the image forming process is repeatedly executed based on the image data of low printing ratio.

For example, it is possible to cause deterioration of the toner within the developing processor, if a power supply of the image forming device is turned on the first thing in the morning, and it is kept under a standby state for all day and almost no image forming process is executed.

SUMMARY OF THE INVENTION

In view of the foregoing problems, an object of the present invention is to provide an image forming device that is capable of preventing deterioration of an image quality caused by deterioration of the toner, even in a case where frequency of executing an image forming process is low.

In order to achieve the foregoing object, an image forming device of the present invention includes: a developing part having a developing roller for achieving development by electrostatically attaching a toner onto an electrostatic latent image formed on a photoreceptor; a transferring part for transferring a developed toner image to a paper; a cleaner part for removing and collecting the toner remained on the photoreceptor after transferring; a developing-roller speed switching part for rotary-driving the developing roller at a lower speed than a speed of development under a standby state; and a standby-state refresh control part for forcibly consuming an amount of the toner calculated based on accumulated time of the low-speed rotary drive.

Further, other aspects of the present invention will become clear by referring to embodiments provided hereinafter.

BRIEF DESCRIPTION OF THE DRAWINGS

FIG. 5 is an illustration for describing table data showing toner amount to be consumed that is set in accordance with low-speed accumulated time of a developing roller;

FIG. 7 is a flowchart for describing processing that is executed by a standby-state refresh control part when a power supply switch is turned on;

FIG. 13 is an illustration for describing table data showing toner amount to be consumed that is set in accordance with printing ratios.

DESCRIPTION OF THE PREFERRED EMBODIMENTS

A digital copying machine will be described hereinafter, which is an example of an image forming device according to the present invention.

Figure 2:
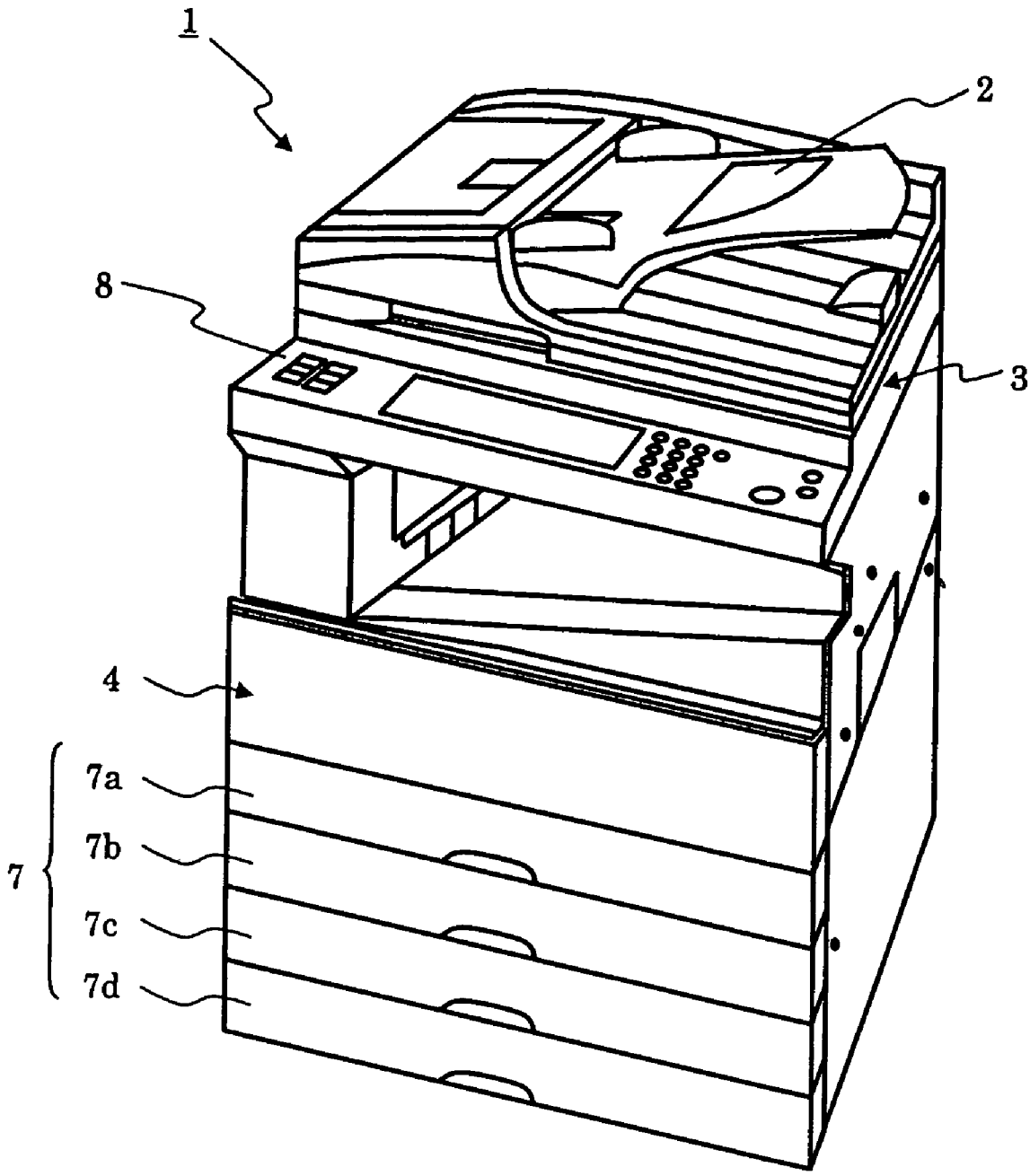
FIG. 2 is an illustration showing an external appearance of the digital copying machine to which the present invention is applied.
Figure 3:
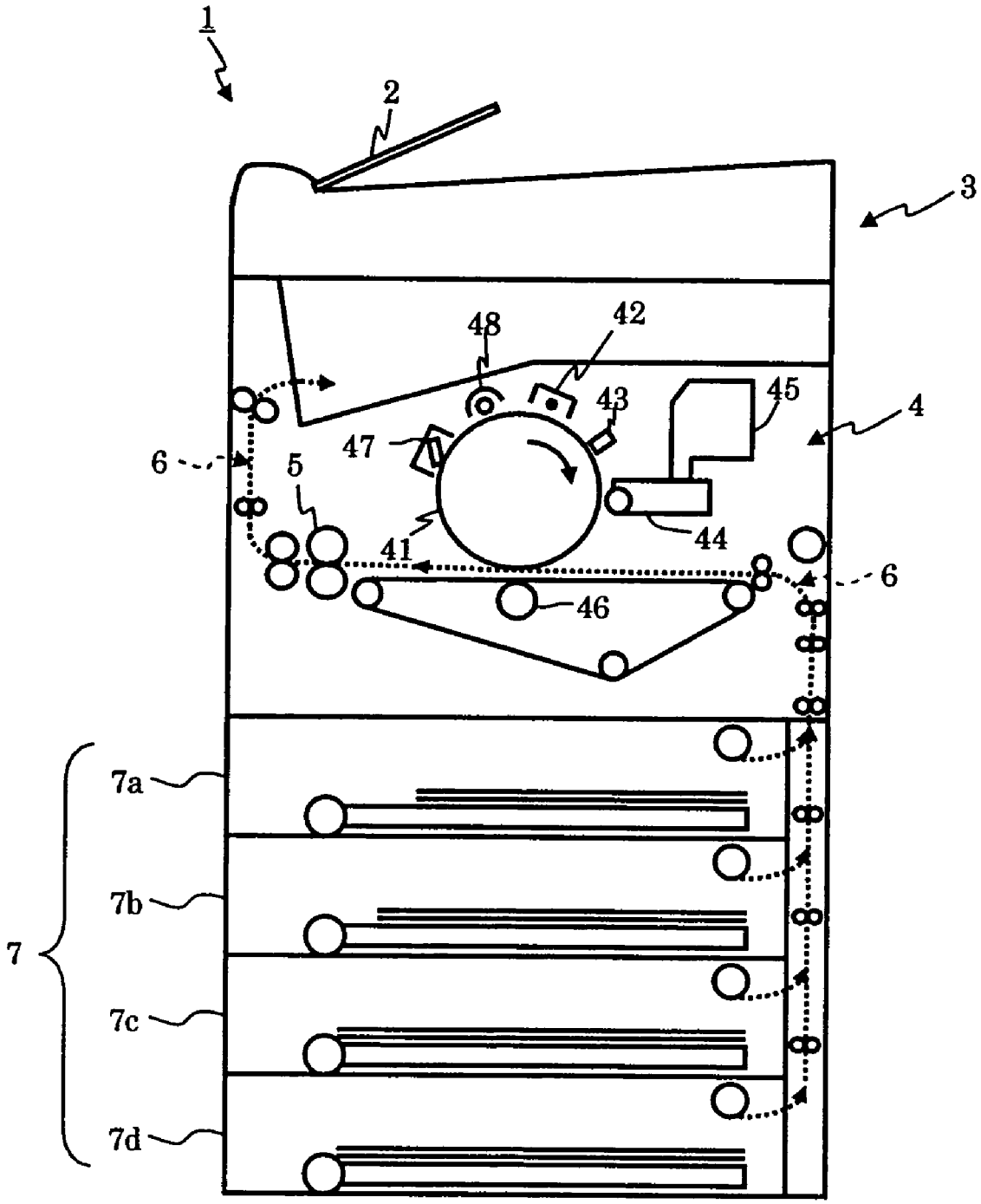
FIG. 3 is a functional block diagram of the digital copying machine to which the present invention is applied.

As shown in FIGS. 2 and 3, a digital copying machine 1 includes: a manuscript loading part 2 for setting a manuscript; an image read part 3 for converting an image read from the manuscript into electronic data; an electrophotographic-type image forming part 4 for forming and outputting a toner image on a paper based on image data that has been converted into the electronic data by the image read part 3; a fixing part 5 for fixing the formed toner image on to the paper by applying heat; a transporting part 6 for transporting the paper; a plurality of paper feeding cassettes 7 (7*a*-7*d*) where papers of different sizes or different kinds are housed; a manual paper feeding port provided on a left-side part of the device; and an operation part 8 where a plurality of menu setting keys and the like for setting various menus are arranged.

Figure 4:
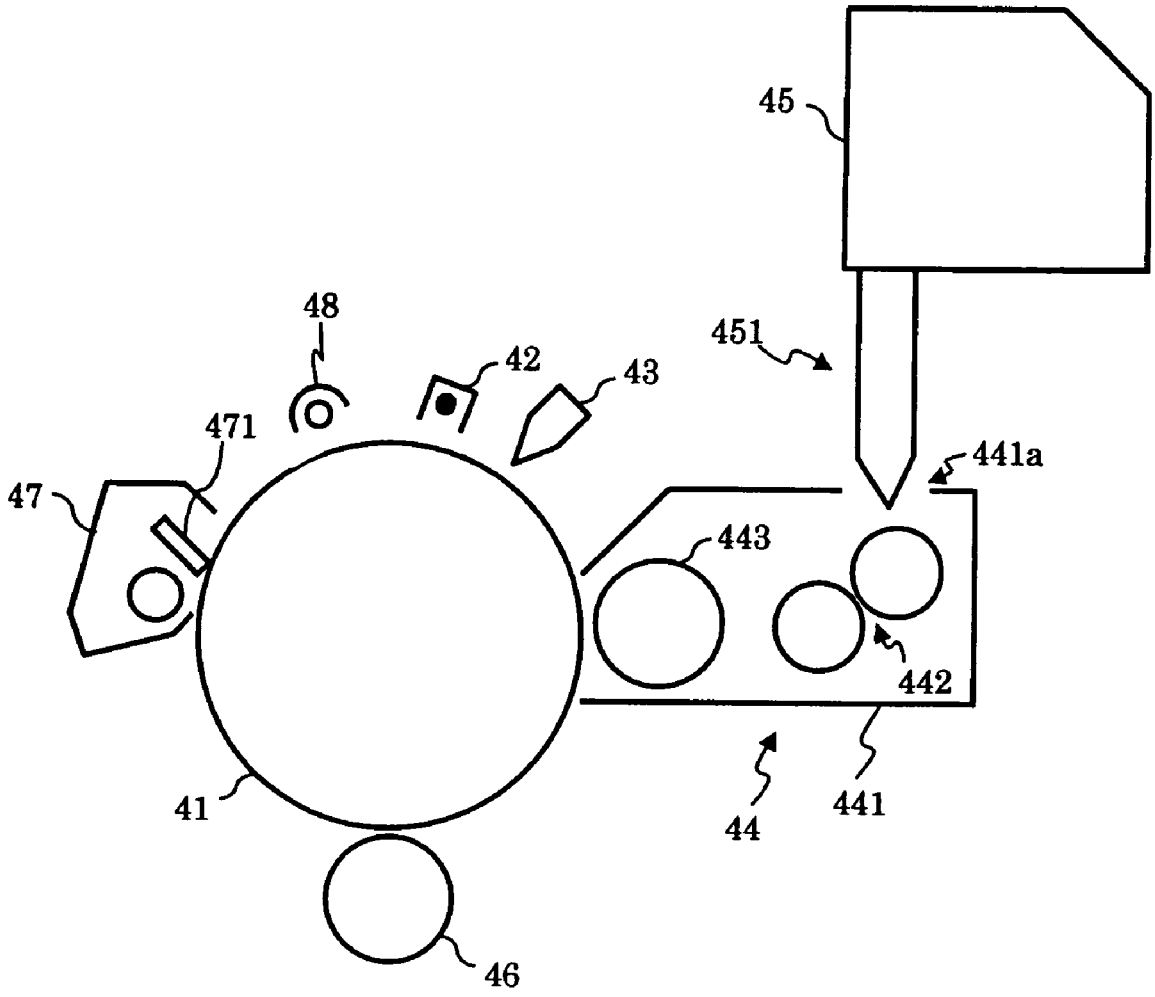
FIG. 4 is an illustration for describing a photoreceptor and a developing part.

As shown in FIGS. 3 and 4, the image forming part 4 includes: a photoreceptor 41 having a photosensitive layer made of amorphous silicon formed on its surface; an electrifying charger 42 disposed in order along the periphery of the photoreceptor 41 for uniformly corona-charging the surface of the photoreceptor 41; a print head 43 for forming an electrostatic latent image by exposing the charged photoreceptor 41; a developing part 44 for developing a toner image by electrostatically attaching a toner to the electrostatic latent image formed on the photoreceptor 41; a toner cartridge 45 as an exchange unit for supplying a new toner to the developing part 44; a transferring part 46 for transferring the developed toner image to a paper; a cleaner part 47 for removing and collecting the toner remained on the photoreceptor 41 after transfer of the toner image to the paper; and an eraser lamp 48 for eliminating a remaining potential on the surface of the photoreceptor 41 to make it uniform.

The developing part 44 includes: a case 441 for housing a developer constituted with a toner and a carrier; a stirring roller 442 for stirring the developer; and a developing roller 443 for achieving development by electrostatically attaching the toner to the electrostatic latent image formed on the photoreceptor 41.

The stirring roller 442 stirs the developer by its rotary actions to cause frictions between the toner and the carrier for charging the toner.

A prescribed developing bias voltage is applied to the developing roller 443. It is constituted to have the toner splashed to an electrostatic latent image area of the photoreceptor 41 that is charged to an opposite polarity from an electrified charge of the toner, through introducing the toner charged by the stirring roller 442 onto the surface of the photoreceptor 41 by the rotary actions of the stirring roller 442.

A toner supply port 451 provided at a lower end part of the toner cartridge 45 is attached to be connected to a toner supply hole 441*a* that is provided to the case 441. The toner filled in the toner cartridge 45 is supplied to the developing part 44 via the toner supply port 451.

A transfer bias voltage having an opposite polarity from the charge polarity of the toner is applied to the transferring part 46 by a bias power supply, so that the toner image attached to a surface of the photoreceptor 41 is transferred by an electric field generated by the transfer bias voltage to a paper transported between the transferring part 46 and the photoreceptor 41.

The cleaner part 47 includes a cleaning blade 471 formed with an elastic substance such as urethane rubber that is provided by abutting against the photoreceptor 41. With the cleaning blade 471, the toner remained on the surface of the photoreceptor 41 is removed.

Figure 1:
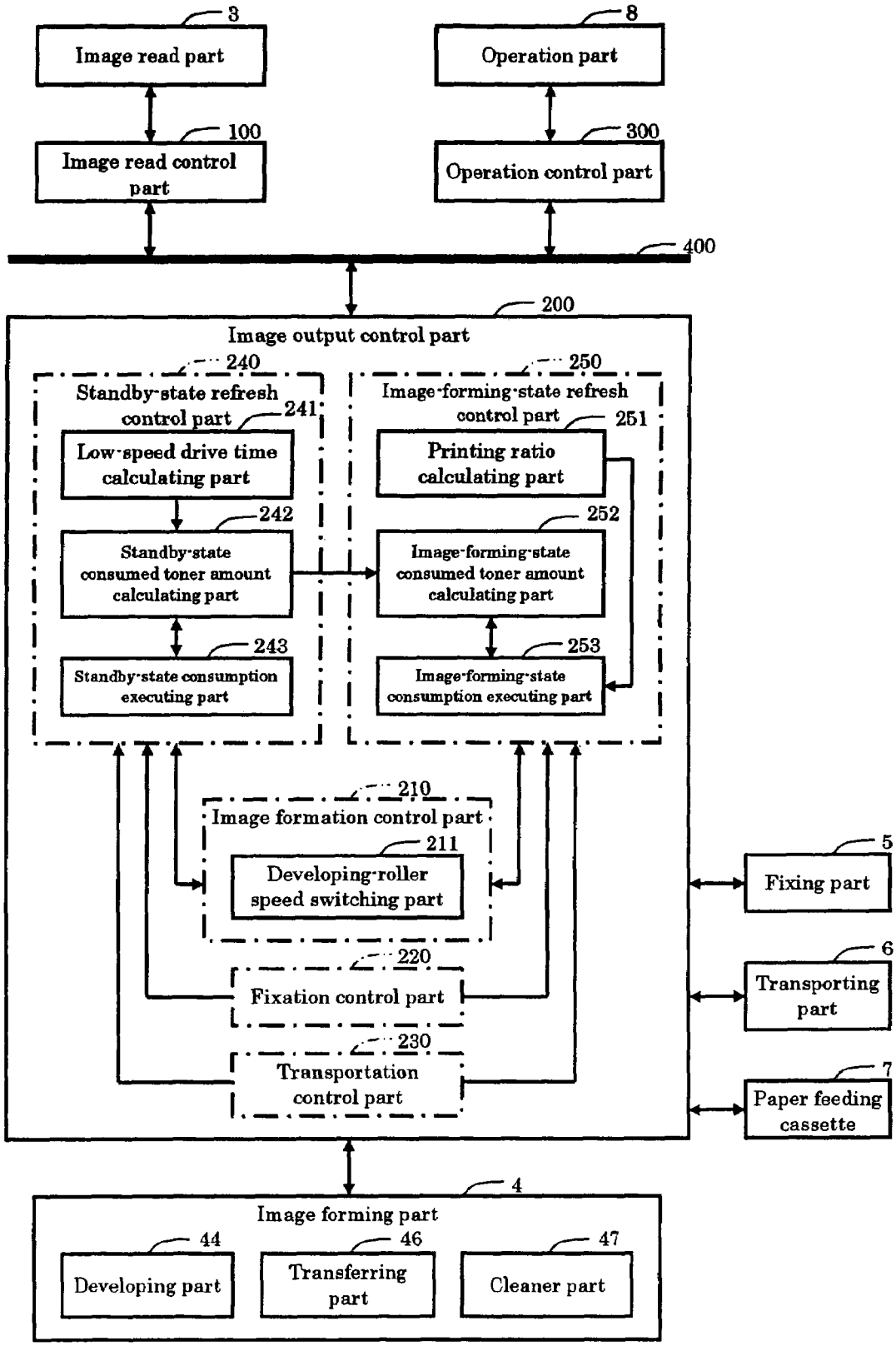
FIG. 1 is a control block diagram of a digital copying machine to which the present invention is applied.

As shown in FIG. 1, the digital copying machine 1 is provided with a plurality of control parts for controlling each of above-described functional blocks. Specifically, the digital copying machine 1 includes: an image read control part 100 for controlling read operations of manuscripts by the image read part 3; an image output control part 200 for performing general control of the system of the digital copying machine and for controlling the image forming part 4, the fixing part 5, the transporting part 6, and the paper feeding cassettes 7 as well; and an operation control part 300 for controlling input/output signals of the operation part 8.

Each of the control parts 100, 200, and 300 includes: a single or a plurality of CPU(s); a ROM where control programs executed by the CPU are stored; a RAM for storing control data; a single or a plurality of control board(s) having an input/output interface circuit and the like provided for outputting signals to various loads as control targets and for inputting detected values from various sensors, and the like.

There is built a distributed-type control system where each CPU is connected mutually with a serial communication line 400, and it is constituted to achieve prescribed functions, which are to be described in detail hereinafter, through the control programs executed by each CPU and related hardware circuits.

The image output control part 200 includes: an image formation control part 210 for controlling the image forming part 4; a fixation control part 220 for controlling the fixing part 5; a transportation control part 230 for controlling the transporting part 6; a standby-state refresh control part 240 for forcibly consuming a prescribed amount of the toner under a standby state where the image formation process by the image formation control part 210 is not being executed; and an image-forming-state refresh control part 250 for forcibly consuming a prescribed amount of the toner when development processing of an image having a lower printing ratio of the image than a prescribed printing ratio is continuously executed.

A developing-roller speed switching part 211 is provided to the image formation control part 210. The developing-roller speed switching part 211 rotary-drives the developing roller 443 at a prescribed developing speed within a range of one-three times as fast as a circumferential speed of the photoreceptor 41 when the image formation process is executed by the image formation control part 210, while rotary-driving the developing roller 443 at a lower speed than the developing speed when the image formation process is not executed by the image formation control part 210.

The standby-state refresh control part 240 includes: a low-speed drive time calculating part 241 for calculating accumulated time where the developing roller 443 is rotary-driven at a low speed; a standby-state consumed toner amount calculating part 242 for calculating the toner amount to be forcibly consumed based on the accumulated time that is calculated by the low-speed drive time calculating part 241; and a standby-state consumption executing part 243 for forcibly consuming the toner amount that is calculated by the standby-state consumed toner amount calculating part 242 with the image formation control part 210 at a prescribed timing.

The low-speed drive time calculating part 241 starts a counter that is provided to itself, when the developing-roller speed switching part 211 switches the speed of the developing roller 443 from the developing speed to a low speed, and stops the counter when the developing-roller speed switching part 211 switches the speed of the developing roller 443 from the low speed to the developing speed.

Then, the low-speed drive time calculating part 241 starts the counter when the developing-roller speed switching part 211 switches the speed of the developing roller 443 from the developing speed to the low speed again, and controls the counter to continue counting from a previous count value.

The low-speed drive time calculating part 241 repeats such processing to calculate the accumulated time where the developing roller 443 is rotary-driven at the low speed. The counter is reset when a power supply switch of the digital copying machine 1 is turned off, and when a date set in a built-in clock provided within the device changes while the digital copying machine 1 is being shifted to a power saving mode.

When receiving an instruction for calculating the toner amount from the standby-state consumption executing part 243 to be described later, the standby-state consumed toner amount calculating part 242 calculates the toner amount to be forcibly consumed by the image forming part 4 or the toner consuming processing execution time by referring to a current value of the counter.

As shown in FIG. 5, table data showing corresponding relations between the toner amount to be consumed as well as the toner consumption processing execution time and the counter values is stored in advance in a ROM of the image output control part 200. Upon receiving an instruction for calculating the toner amount from the standby-state consumption executing part 243, the standby-state consumed toner amount calculating part 242 calculates the toner amount to be forcibly consumed by the image forming part 4 or the toner consumption processing execution time from the current value of the counter by referring to the table data.

In the present embodiment, the standby-state consumed toner amount calculating part 242 judges that the digital copying machine 1 is in a state right after being turned on or right after returned from the power saving mode when the counter value indicates "0", and calculates maximum values stored in the table data as the toner amount to be forcibly consumed by the image forming part 4 and as the toner consumption processing execution time.

The standby-state consumption executing part 243 forcibly consumes the toner at a timing of turning on the power supply switch, turning off the power supply switch, returning from the power saving mode, or right before forming an image.

That is, when recognizing that it is at one of the above-described timings based on a signal transmitted from the image formation control part 210 or the operation part 8, the standby-state consumption executing part 243 outputs an instruction for calculating the toner amount to the standby-state consumed toner amount calculating part 242.

Then, when receiving a signal from the standby-state consumed toner amount calculating part 242 indicating that the calculation of the toner amount has been completed, the forcible consumption of the toner is executed by the image formation control part 210. If the developing roller 443 is rotated at a low speed at this point, a signal is transmitted to the developing-roller speed switching part 211 to change a rotation sped of the developing roller 443 from the low speed to the developing speed in order to execute the forcible consumption of the toner.

The forcible consumption process of the toner will be described hereinafter.

Figure 6A:
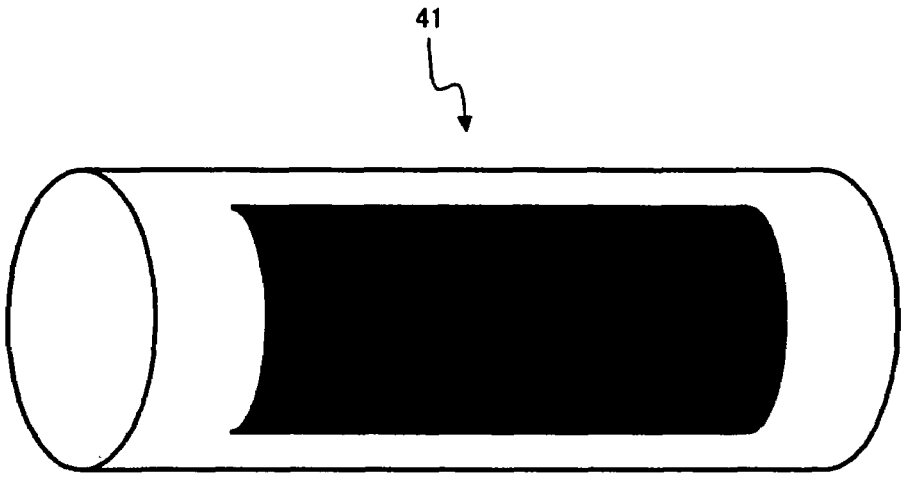
FIG. 6A is an illustration for describing an electrostatic latent pattern painted solid in black all over, which is formed on the photoreceptor when forcibly consuming the toner.
Figure 6B:
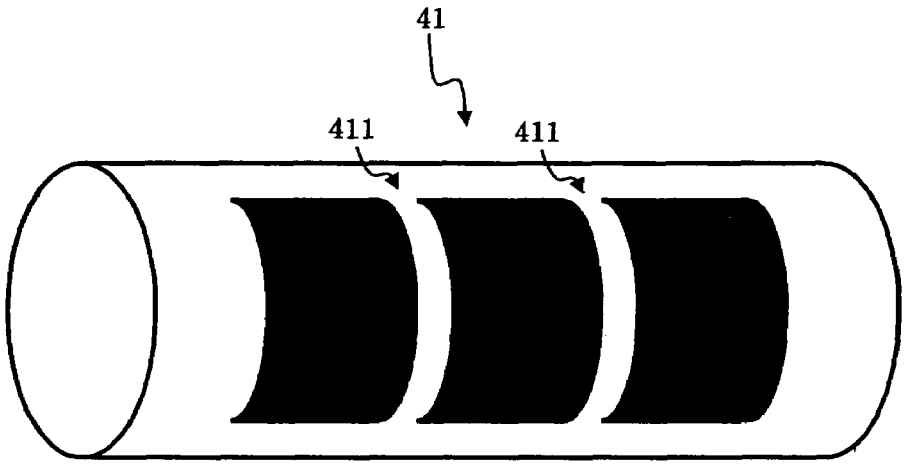
FIG. 6B is an illustration for describing a plurality of solid-black electrostatic latent image patterns formed at a prescribed interval on the photoreceptor when forcibly consuming the toner.

An electrostatic latent image in a prescribed pattern that is set in advance for forcible consumption of the toner is formed on a surface of the photoreceptor 41 by the print head 43. For example, the prescribed pattern is a pattern painted solid in black all over as shown in FIG. 6A or a pattern where a space that is not painted solid in black is provided at least in a single prescribed position 411 (two positions in FIG. 6B) within an area that is painted solid in black as shown in FIG. 6B.

The prescribed position 411 is set at a position of a separation claw provided to the photoreceptor 41 for preventing the paper that has passed through the transferring part 46 from being twined while sticking to the photoreceptor 41. Since a tip of the separation claw is located at a position to be in contact with the photoreceptor 41 or a neighboring position, the toner attaches to the tip of the separation claw when a toner image painted solid in black is formed at a position where the separation claw is provided. This may leave a smudge on a paper to which an image formed on the photoreceptor 41 is transferred later on, so that the space 411 where no toner is attached is formed in the prescribed position 411 for preventing it.

Further, it is desirable that the prescribed pattern be a pattern where the charged toner is attached in a fine manner, and a carrier provided together with the toner within the developing part 44 is not easily attached. It is because the carrier attached to the photoreceptor 41 may damage the photoreceptor 41 by being rubbed against the photoreceptor 41 by the cleaning blade 471.

Figure 6C:
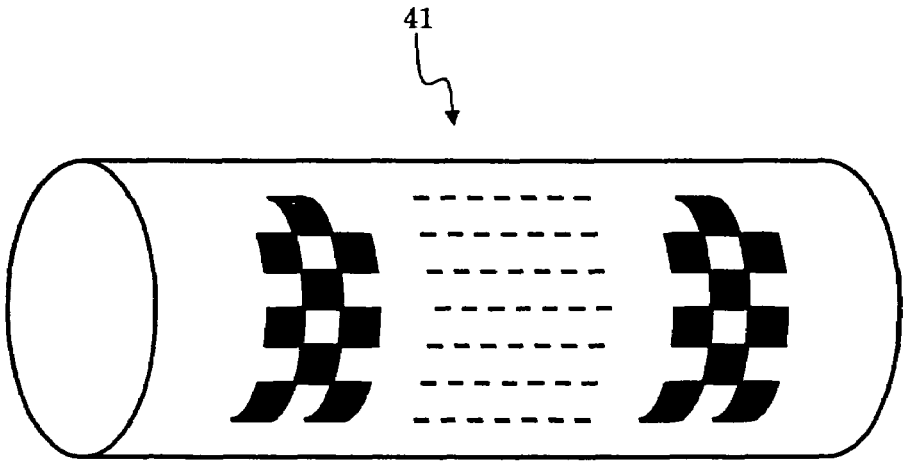
FIG. 6C is an illustration for describing checkerwise electrostatic latent image patterns formed on the photoreceptor when forcibly consuming the toner.

A checkerwise pattern shown in FIG. 6C is a preferable example of the pattern with which the carrier is not easily attached to the photoreceptor 41. In FIGS. 6A to 6C, the black-colored parts are the toner attached areas.

When forcibly consuming the toner, a transfer bias voltage is not applied to the transferring part 46. It is because the toner of the prescribed pattern formed on the photoreceptor 41 is transferred from the photoreceptor 41 to the transferring part 46, if the transfer bias voltage is applied.

The toner attached to the photoreceptor 41 passes through the transferring part 46 and reaches the cleaner part 47, and it is removed by the cleaning blade 471. The forcible consuming process of the toner is thereby completed.

As described above, it is controlled by the standby-state refresh control part in such a manner that the forcible consumed amount of the toner increases as the accumulated time where the developing roller is rotary-driven at a low speed under a standby state becomes longer. Therefore, it is possible to prevent deterioration in the quality of the image by securely executing forcible consumption of the toner that is deteriorated during the standby state.

Hereinafter, processing executed at each of the described timings by the standby-state refresh control part 240 will be described by referring to flowcharts shown in FIGS. 7 to 10.

Figure 7:
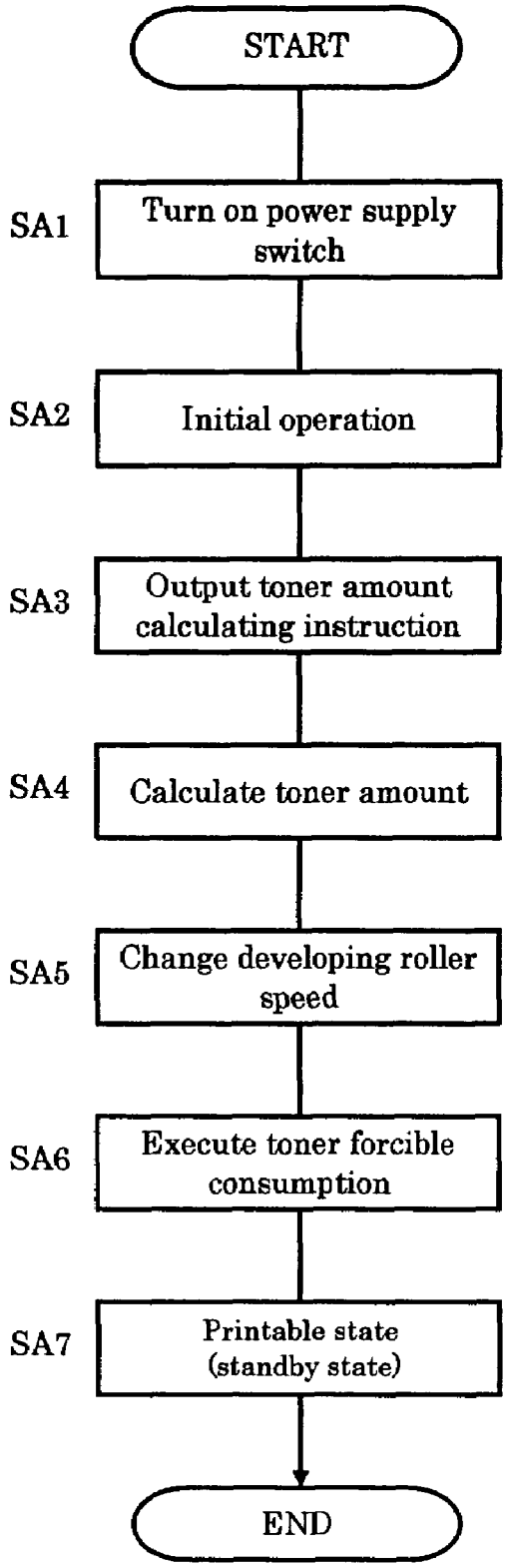

First, the processing executed by the standby-state refresh control part 240 when the power supply switch is turned on will be described by referring to the flowchart shown in FIG. 7.

When the power supply switch of the digital copying machine 1 is switched from off to on (SA1), each functional block executes initial operations for bringing the digital copying machine 1 into an operable condition (SA2). For example, the developing bias voltage applied to the developing part 44 is adjusted, and the fixing part 5 is heated to a prescribed temperature by a supply of electricity to the heater.

When the initial operation of the image forming part 4 is completed in the step SA2, the standby-state consumption executing part 243 outputs an instruction for calculating the toner amount to be forcibly consumed to the standby-state consumed toner amount calculating part 242 (SA3).

Upon receiving the instruction, the standby-state consumed toner amount calculating part 242 refers to the counter provided to the low-speed drive time calculating part 241, for executing calculation of the toner amount to be forcibly consumed. The counter is reset to "0" when the power supply is turned off. Thus, the standby-state consumed toner amount calculating part 242 calculates the maximum value of the toner amount to be consumed or the maximum value of the toner consumption processing execution time set in advance in the table data that is stored in the ROM of the image output control part 200 as the toner amount to be forcibly consumed (log based on FIG. 5) or the toner consumption processing execution time (10 seconds based on FIG. 5) (SA4).

Further, when the developing roller 443 is rotated at a low speed, the standby-state consumption executing part 243 transmits a signal to the developing-roller speed switching part 211 to change the rotation speed of the developing roller 443 from the low speed to the developing speed (SA5).

Then, the standby-state consumption executing part 243 has the image formation control part 210 control the image forming part 4 to execute the forcible consumption of the toner (SA6).

When the forcible consumption of the toner is completed, the digital copying machine 1 is turned into a printable condition to be under a standby state. The standby-state consumption executing part 243 transmits a signal to the developing-roller speed switching part 211 to change the rotation speed of the developing roller 443 from the developing speed to the low speed, and starts counting by the counter of the low-speed drive time calculating part 241 (SA7).

Figure 8:
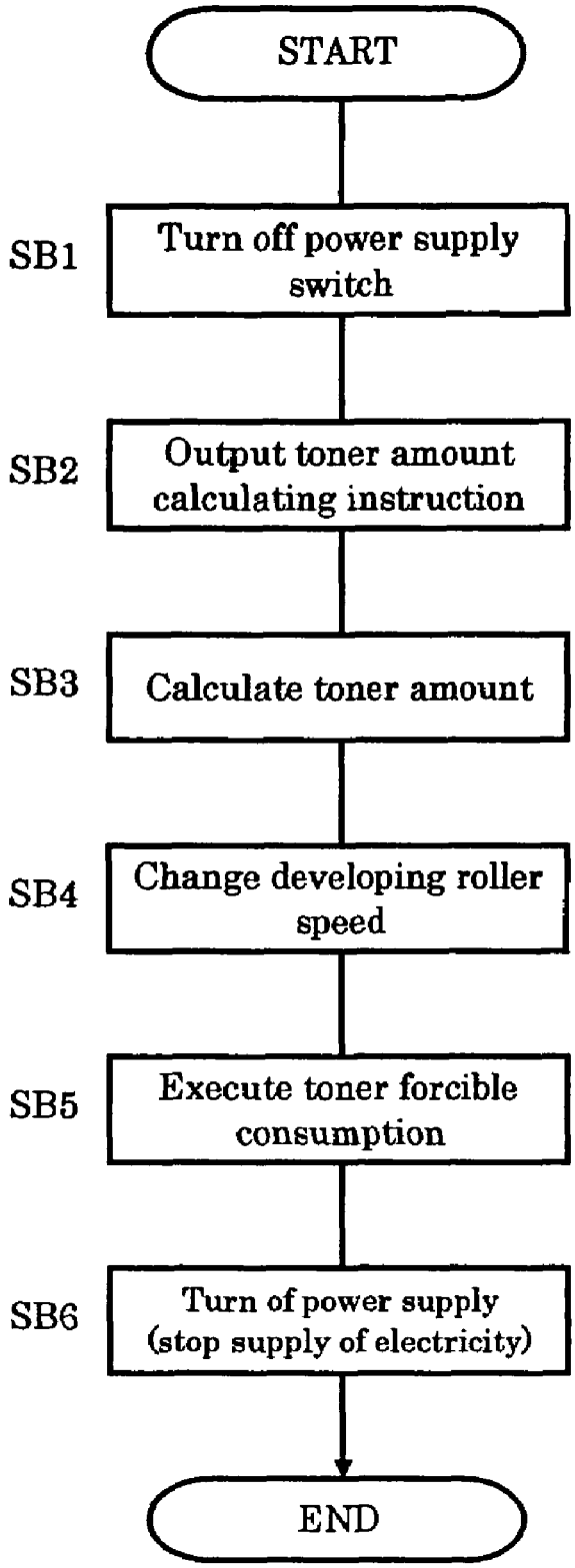
FIG. 8 is a flowchart for describing processing that is executed by the standby-state refresh control part when the power supply switch is turned off.

Next, the processing executed by the standby-state refresh control part 240 when the power supply switch is turned off will be described by referring to the flowchart shown in FIG. 8.

When the power supply switch of the digital copying machine 1 is switched from on to off (SB1), the standby-state consumption executing part 243 outputs an instruction for calculating the toner amount to the standby-state consumed toner amount calculating part 242 (SB2).

Upon receiving the instruction, the standby-state consumed toner amount calculating part 242 refers to the counter provided to the low-speed drive time calculating part 241, for executing calculation of the toner amount. The standby-state consumed toner amount calculating part 242 refers to the table data stored in the ROM of the image output control part 200 to calculate the toner amount to be consumed and the toner consumption processing execution time corresponding to the counter value (SB3).

Further, when the developing roller 443 is rotated at a low speed, the standby-state consumption executing part 243 transmits a signal to the developing-roller speed switching part 211 to change the rotation speed of the developing roller 443 from the low speed to the developing speed (SB4).

Then, the standby-state consumption executing part 243 has the image formation control part 210 control the image forming part 4 to execute the forcible consumption of the toner (SB5).

When the forcible consumption of the toner is completed, the image output control part 200 controls to shut down the power supply after completion of the processing that needs to be executed by the whole functional blocks that constitute the digital copying machine 1 before stopping the supply of electricity (SB6). The processing that needs to be executed before stopping the supply of electricity is processing of saving important data to the memory, and the like, for example.

Figure 9:
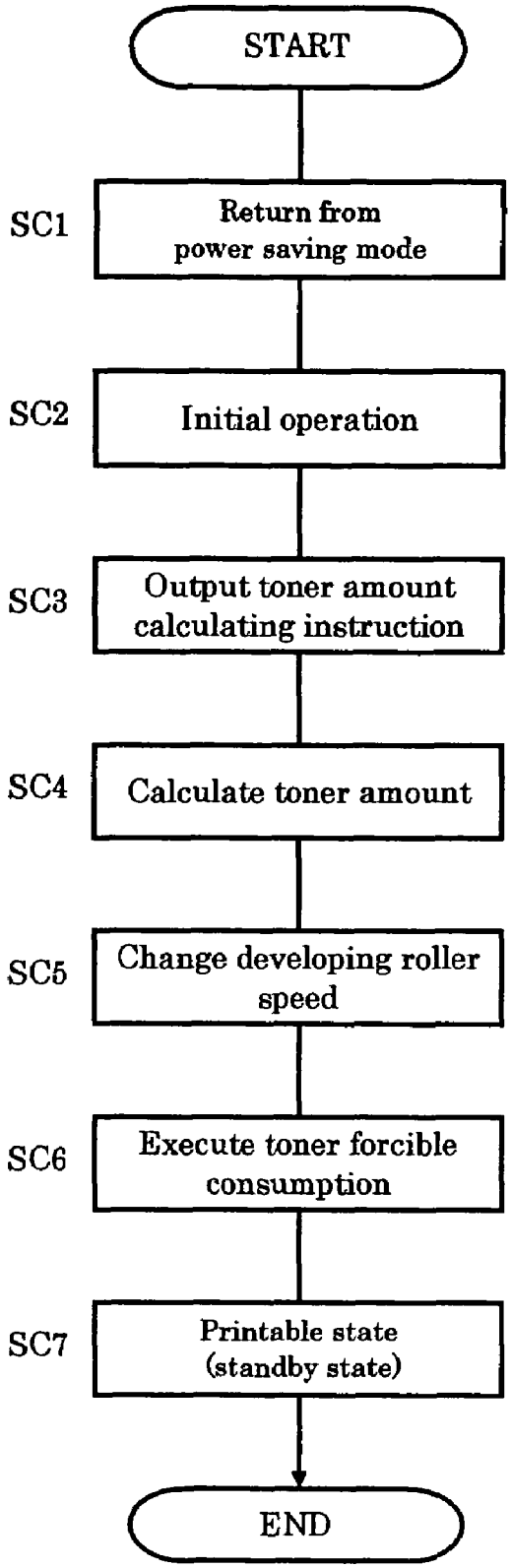
FIG. 9 is a flowchart for describing processing that is executed by the standby-state refresh control part when returning from a power saving mode.

Next, the processing executed by the standby-state refresh control part 240 when returning from the power saving mode will be described by referring to the flowchart shown in FIG. 9.

If some kind of operation is entered to the operation part 8 or if it is detected that the power saving mode switch is turned on while the digital copying machine 1 is being shifted to the power saving mode, the digital copying machine 1 shifts from the power saving mode to a normal electricity supply mode (SC1). At this point, each of the functional blocks requiring the initial operation executes the initial operation for bringing the digital copying machine 1 into the operable condition (SC2).

When an initial operation of the image forming part 4 is completed in the step SC2, the standby-state consumption executing part 243 outputs an instruction for calculating the toner amount to the standby-state consumed toner amount calculating part 242 (SC3).

Upon receiving the instruction, the standby-state consumed toner amount calculating part 242 refers to the counter provided to the low-speed drive time calculating part 241, for executing calculation of the toner amount. The standby-state consumed toner amount calculating part 242 refers to the table data stored in the ROM of the image output control part 200 to calculate the toner amount to be consumed and the toner consumption processing execution time corresponding to the counter value (SC4).

In step SC4, when the date of the clock provided to the digital copying machine 1 has changed while the digital copying machine 1 is being shifted to the power saving mode, the counter is reset to "0". Therefore, the calculated toner amount to be consumed or toner consumption processing execution time becomes the maximum amount or the maximum time stored in the table data.

Further, when the developing roller 443 is rotated at a low speed, the standby-state consumption executing part 243 transmits a signal to the developing-roller speed switching part 211 to change the rotation speed of the developing roller 443 from the low speed to the developing speed (SC5).

Then, the standby-state consumption executing part 243 has the image formation control part 210 control the image forming part 4 to execute the forcible consumption of the toner (SC6).

When the forcible consumption of the toner is completed, the digital copying machine 1 is turned into a printable condition to be under a standby state (SC7). That is, the standby-state consumption executing part 243 transmits a signal to the developing-roller speed switching part 211 to change the rotation speed of the developing roller 443 from the developing speed to the low speed, and starts counting by the counter of the low-speed drive time calculating part 241.

Figure 10:
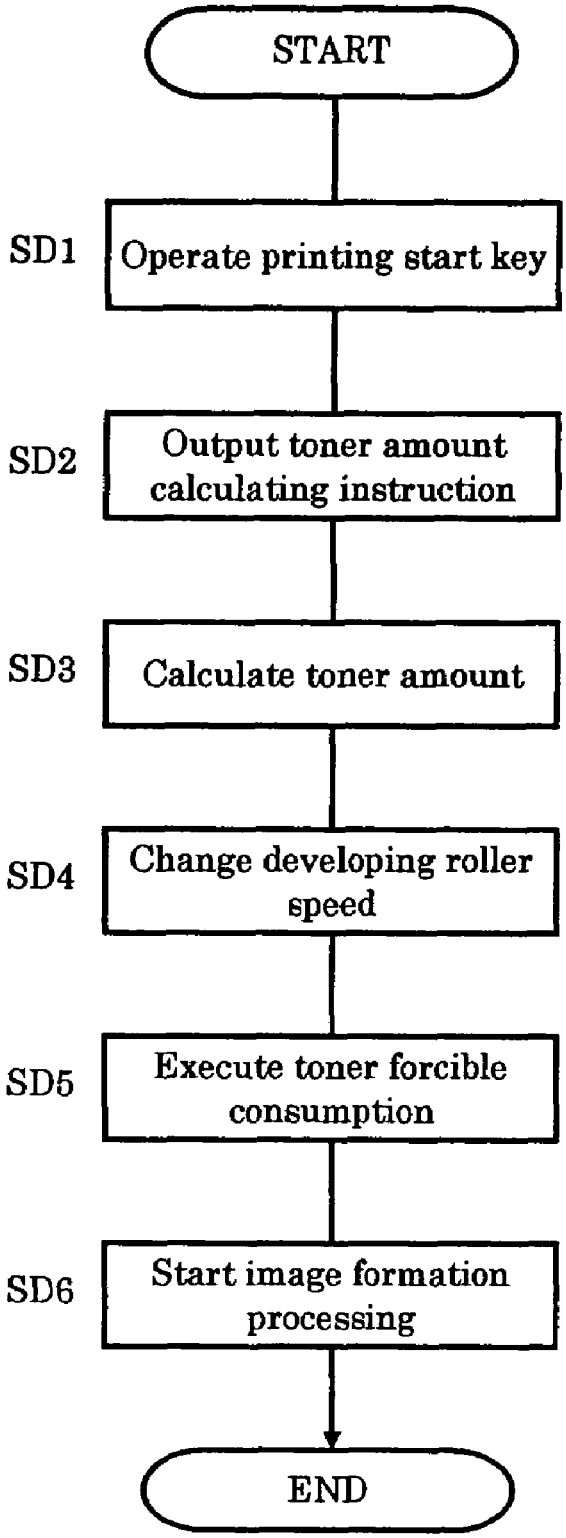
FIG. 10 is a flowchart for describing processing that is executed by the standby-state refresh control part right before forming an image.

Further, the processing executed by the standby-state refresh control part 240 right before forming an image will be described by referring to a flowchart shown in FIG. 10.

When an operator operates a printing start key of the operation part 8 (SD1), the image output control part 200 has the standby-state refresh control part 240 execute the forcible consumption of the toner before having the image formation control part 210 start the image formation processing.

That is, the standby-state consumption executing part 243 outputs an instruction for calculating the toner amount to the standby-state consumed toner amount calculating part 242 (SD2).

Upon receiving the instruction, the standby-state consumed toner amount calculating part 242 refers to the counter provided to the low-speed drive time calculating part 241, for executing calculation of the toner amount. The standby-state consumed toner amount calculating part 242 refers to the table data stored in the ROM of the image output control part 200 to calculate the toner amount to be consumed and the toner consumption processing execution time corresponding to the counter value (SD3).

Further, when the developing roller 443 is rotated at a low speed, the standby-state consumption executing part 243 transmits a signal to the developing-roller speed switching part 211 to change the rotation speed of the developing roller 443 from the low speed to the developing speed (SD4).

Then, the standby-state consumption executing part 243 has the image formation control part 210 control the image forming part 4 to execute the forcible consumption of the toner (SD5).

When the forcible consumption of the toner is completed, the image formation control part 210 starts the image formation processing (SD6).

The image-forming-state refresh control part 250 includes: a printing ratio calculating part 251 for calculating a printing ratio; an image-forming-state consumed toner amount calculating part 252 for calculating the toner amount calculated based on the printing ratio, or the amount of the toner obtained by adding the toner amount to the calculated toner amount by the standby-state consumed toner amount calculating part 242 as the toner amount to be forcibly consumed; and an image-forming-state consumption executing part 253 for forcibly consuming the toner amount calculated by the image-forming-state toner consumed toner amount calculating part 252 with the image formation control part 210 at a prescribed timing.

The printing ratio calculating part 251 calculates an area of a whole paper (whole area) and an area of the part with printing on the paper (printed area), and calculates a proportion of the printing area with respect to the whole area as a printing ratio. The printing ratio may also be calculated by using the number of dots used for paining the whole paper solid in black and the number of dots in the printed part instead of using the areas.

The image-forming-state consumed toner amount calculating part 252 compares the above-described printing ratio with a threshold value that is set in advance. Then, when a state where the printing ratio is smaller than the threshold value continues for a prescribed number of papers in the image formation processing, the image-forming-state consumed toner amount calculating part 252 calculates prescribed toner amount or prescribed toner consumption processing execution time (these are referred to as a first forcible consumed amount) to be forcibly executed by the image forming part 4.

Further, the image-forming-state consumed toner amount calculating part 252 calculates a value obtained by adding the toner amount or the toner consumption processing execution time calculated by the standby-state consumed toner amount calculating part 242 to the calculated toner amount or toner consumption processing execution time as prescribed toner amount or prescribed toner consumption processing execution time (these are referred to as a second forcible consumed amount) to be forcibly consumed by the image forming part 4.

Whether to calculate the first forcible consumed amount or the second forcible consumed amount by the image-forming-state consumed toner amount calculating part 252 can be switched based on a switching operation of the operator executed on a switching switch provided to the operation part 8.

The image-forming-state consumption executing part 253 is structured to execute forcible consumption of the toner right before or after the image formation processing or between the images of the continuous image formation processing.

That is, upon recognizing that it is at one of the above-described timings based on a signal transmitted from the image formation control part 210, the image-forming-state consumption executing part 253 outputs an instruction for calculating the toner amount to the image-forming-state consumed toner amount calculating part 252. Upon receiving a signal from the image-forming-state consumed toner amount calculating part 252 indicating that the calculation of the toner amount has been completed, the image-forming-state consumption executing part 253 has the image formation control part 210 control the image forming part 4 to execute forcible consumption of the toner.

When the developing roller 443 is rotated at a low speed, a signal is transmitted to the developing-roller speed switching part 211 to change the rotation speed of the developing roller 443 from the low speed to the developing speed in order to execute forcible consumption of the toner.

The processing executed by the image-forming-state refresh control part 250 at each of the above-described timings will be described by referring to the flowcharts shown in FIGS. 11 and 12.

First, the processing executed by the image-forming-state refresh control part 250 right before the image formation processing or between the images of the continuous image formation processing will be described by referring to the flowchart of FIG. 11. In the explanations below, described is a case where the image-forming-state consumed toner amount calculating part 252 calculates the second forcible consumed amount.

When an operator operates the printing start key that is provided to the operation part 8 (SE1), the image output control part 200 has the image-forming-state refresh control part 250 execute the forcible consumption of the toner before having the image formation control part 210 start the image formation processing.

That is, the image-forming-state consumption executing part 253 outputs an instruction for calculating the toner amount to the image-forming-state consumed toner amount calculating part 252 (SE2).

Since there is no such condition generated before the image formation processing that a print having a smaller printing ratio than the threshold value is continuously formed for a prescribed number of papers, the image-forming-state consumed toner amount calculating part 252 upon receiving the instruction calculates the toner amount or the toner consumption processing execution time calculated by the standby-state consumed toner amount calculating part 242 as the toner amount to be consumed by the image forming part 4 or the toner consumption processing execution time (SE3).

Further, when the developing roller 443 is rotated at a low speed, the image-forming-state consumption executing part 253 transmits a signal to the developing-roller speed switching part 211 to change the rotation speed of the developing roller 443 from the low speed to the developing speed (SE4).

Then, the image-forming-state consumption executing part 253 has the image formation control part 210 control the image forming part 4 to execute the forcible consumption of the toner (SE5).

When the forcible consumption of the toner is completed, the image formation control part 210 starts the image formation processing (SE6).

When the image formation processing for a given paper is ended, the image formation control part 210 judges whether or not the image formation processing for all the papers required to have the printing is completed (SE7). If the image formation processing for all the papers is completed, the image formation control part 210 ends the printing.

Meanwhile, if the image formation processing for all the papers is not completed (SE7), the printing ratio calculating part 251 calculates the printing ratio (SE8), and the image-forming-state consumed toner amount calculating part 252 compares the printing ratio with the threshold value that is set in advance (SE9). If the printing ratio is equal to or larger than the threshold value, it is judged whether or not a state where the printing ratio is equal to or larger than the threshold value is continued for a prescribed number of papers (SE10).

When both conditions of the steps SE9 and SE10 are satisfied, the toner forcible consumption processing same as the processing of the steps from SE2 to SE5 is executed (SE11). In the toner forcible consumption processing of the step SE11, the toner amount and the toner consumption processing execution time are calculated based on the printing ratio, unlike the processing of the step SE3.

Meanwhile, when the condition of either the step SE9 or the step SE10 is unsatisfied, the image formation processing for a next paper is started (SE6). Thereafter, a set of the processing is repeated until the image formation processing for all the papers is completed.

Next, the toner forcible consumption processing executed by the image-forming-state refresh control part 250 right after the image formation processing and between the images of the continuous image formation processing will be described by referring to the flowchart of FIG. 12. In the explanations below, only the part different from those explained by referring to FIG. 11 will be described.

Figure 11:
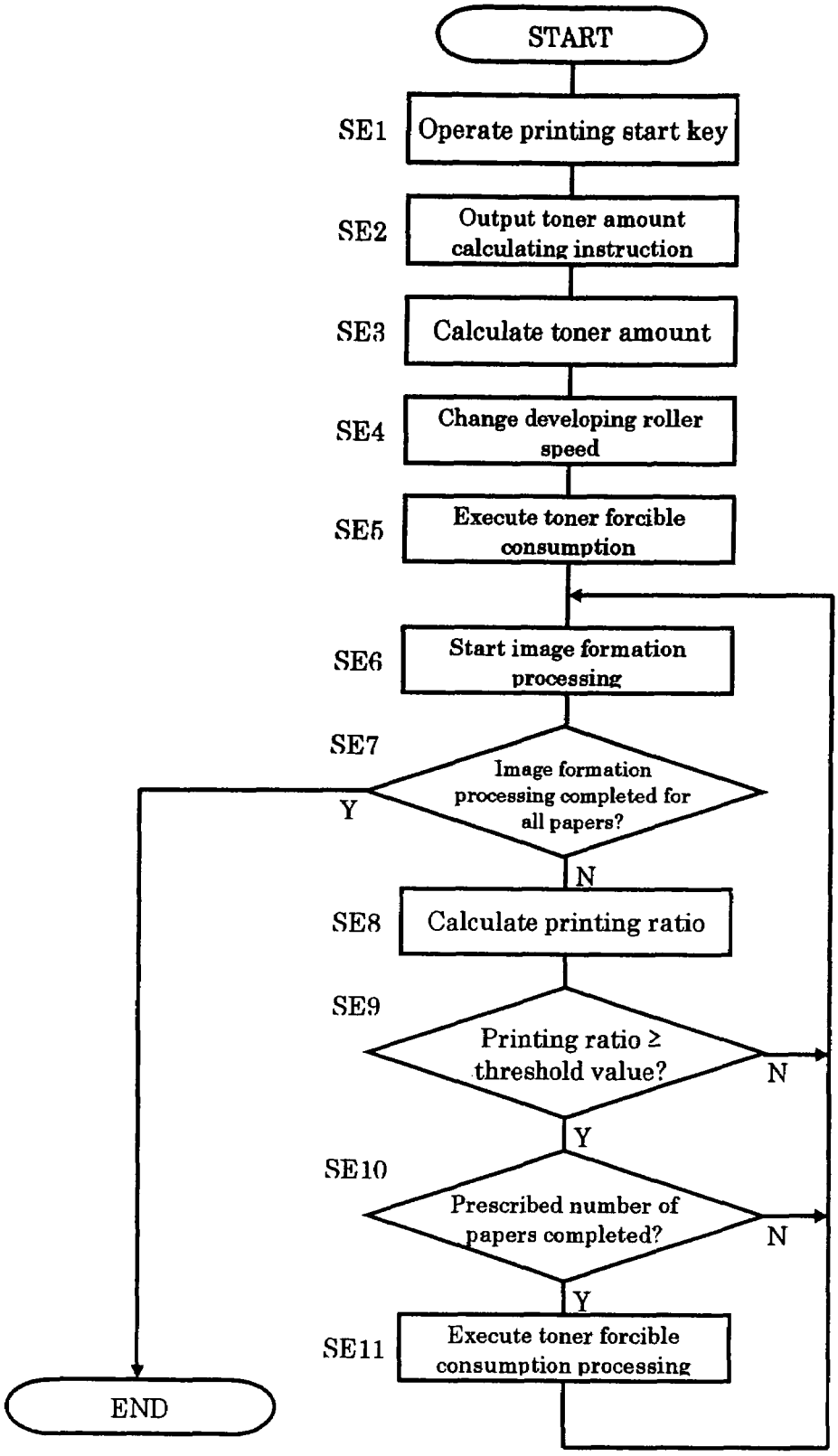
FIG. 11 is a flowchart for describing processing that is executed by an image-forming-state refresh control part right before an execution of image formation processing and between images formed continuously.
Figure 12:
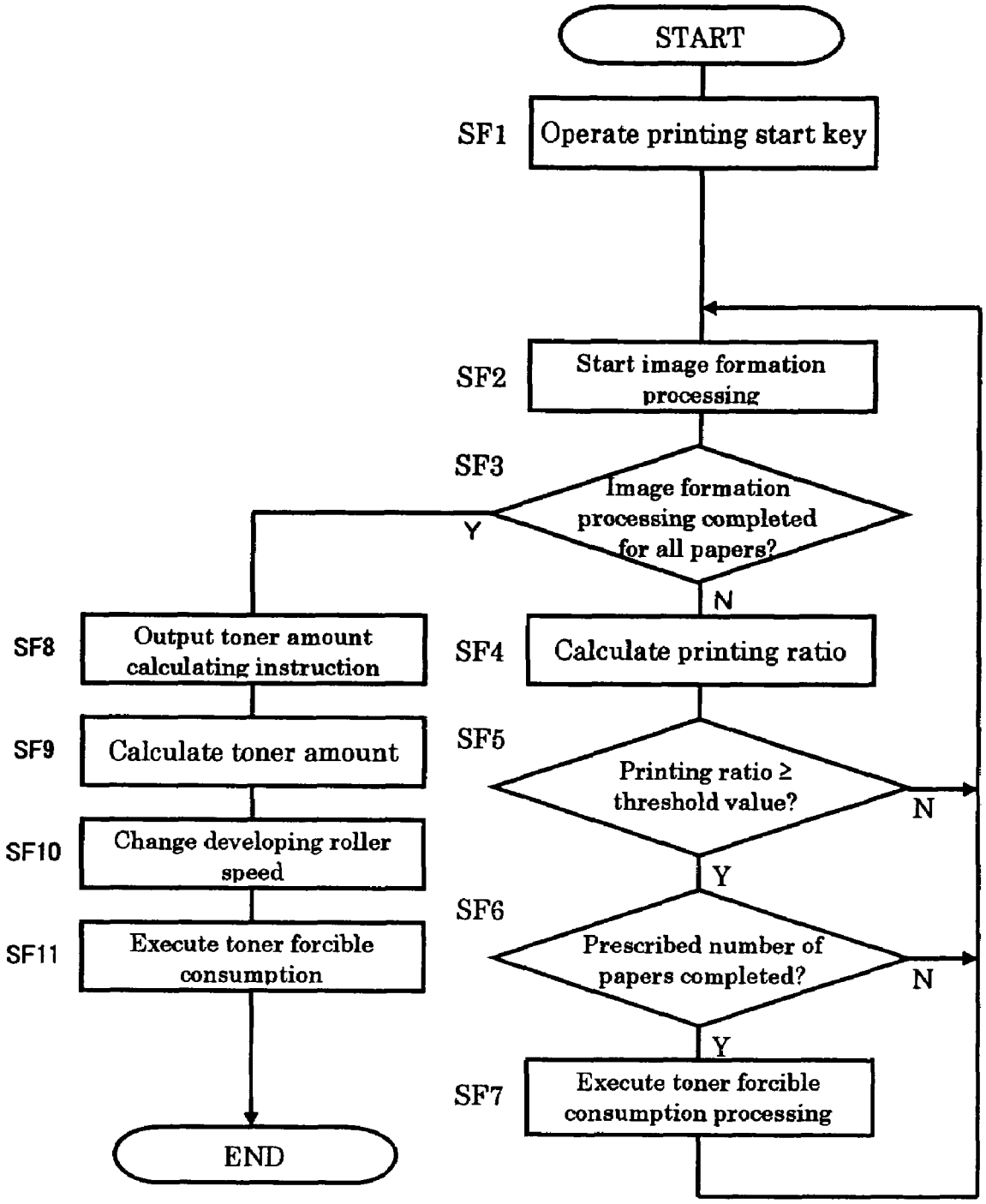
FIG. 12 is a flowchart for describing processing that is executed by the image-forming-state refresh control part right after an execution of the image formation processing and between images of continuous image forming processing.

In FIG. 12, the toner forcible consumption processing executed right before the image formation processing illustrated in the steps from SE2 to SE5 of FIG. 11 is not executed, but the toner forcible consumption processing right after the image formation processing illustrated in steps SF8 to SF11 of FIG. 12 is executed.

With the toner forcible consumption processing illustrated in the step SE11 of FIG. 11 and the step SF7 of FIG. 12, i.e. the processing for forcibly consuming the toner between the images of the continuous image formation processing, there may be cases where it is difficult to execute forcible consumption of the necessary amount of the toner within a limited area such as between the images. In such cases, the image output control part 200 transmits instructions to each functional block to suspend the next image formation processing until the toner forcible consumption processing is completed.

Another embodiment of the present invention will be described hereinafter. In the embodiment above, described is the structure where the standby-state consumed toner amount calculating part 242 calculates the toner amount to be forcibly consumed or the toner consumption processing execution time, upon receiving an instruction for calculating the toner amount from the standby-state consumption executing part 243. However, the standby-state consumed toner amount calculating part 242 may be structured to calculate the toner amount to be forcibly consumed or the toner consumption processing execution time and to transmit it to the standby-state consumption executing part 243, when the accumulated time calculated by the low-speed drive time calculating part 241 exceeds the prescribed time that is set in advance.

In this case, the standby-state consumption executing part 243 suspends the current processing and executes forcible consumption of the toner when the toner amount or the toner consumption processing execution time is transmitted from the standby-state consumed toner amount calculating part 242, even if it is at a timing other than the timing of turning on the power supply switch, turning off the power supply switch, returning from the power saving mode, or right before forming an image.

In the embodiment above, described is the structure where the standby-state consumption executing part 243 or the image-forming-state consumption executing part 253 transmits a signal to the developing-roller speed switching part 211 to switch the speed of the developing roller 443 from a low speed to a developing speed, when the developing roller 443 is rotated at a low speed when executing forcible consumption of the toner. However, it may be structured to execute the forcible consumption of the toner at a low speed.

With this structure, it becomes unnecessary to switch the rotation speed of the developing roller 443 by transmitting a signal from the standby-state consumption executing part 243 or the image-forming-state consumption executing part 253 to the developing-roller speed switching part 211, even if the developing roller 443 is rotated at a low speed when executing forcible consumption of the toner.

In the embodiment above, described is the structure where the image-forming-state consumed toner amount calculating part 252 compares the printing ratio that is calculated by the printing ratio calculating part 251 with the threshold value that is set in advance. However, the image-forming-state consumed toner amount calculating part 252 may be structured to calculate the toner amount or the toner consumption processing execution time by applying the printing ratio that is calculated by the printing ratio calculating part 251 to the table data.

That is, the table data as shown in FIG. 13 where the toner amount to be consumed and the toner consumption processing execution time are related to the printing ratio is stored in advance to the ROM of the image output control part 200, and the image-forming-state consumed toner amount calculating part 252 calculates the toner amount or the toner consumption processing execution time from the printing ratio by referring to the table data upon receiving an instruction for calculating the toner amount from the image-forming-state consumption executing part 253.

In the embodiment above, described is the digital copying machine 1 only capable of monochrome printing, which includes the developing part 44 and the toner cartridge 45 for corresponding to the black toner. However, the present invention can also be applied to a digital copying machine 1 capable of full-color printing, which includes the developing part 44 and toner cartridges 45 for four colors of black, cyan, magenta, and yellow.

What is claimed is:

1. An image forming device, comprising:

a developing part having a developing roller for achieving development by electrostatically attaching a toner onto an electrostatic latent image formed on a photoreceptor;

a transferring part for transferring a developed toner image to a paper;

a cleaner part for removing and collecting the toner that is remained on the photoreceptor after transferring;

a developing-roller speed switching part for rotary-driving the developing roller at a lower speed than a speed of development under a standby state; and a standby-state refresh control part for forcibly consuming an amount of the toner calculated based on accumulated time of the low-speed rotary drive.

2. The image forming device according to claim 1, wherein the standby-state refresh control part forcibly consumes the toner at a timing of turning on a power supply switch, turning off the power supply switch, returning from a power saving mode, or right before forming an image.

3. The image forming device according to claim 1, comprising an image-forming-state refresh control part for forcibly consuming a prescribed amount of the toner, when development processing of an image having a printing ratio for a paper lower than a prescribed printing ratio is continuously executed, wherein the image-forming-state refresh control part forcibly consumes the toner in an amount that is obtained by adding a forcible consumption amount calculated by the standby-state refresh control part to the prescribed amount.

4. The image forming device according to claim 3, wherein the image-forming-state refresh control part forcibly consumes the toner right before or right after execution of image formation processing, or between images of continuous image formation processing.

5. A toner refreshing method for an image forming device, comprising steps of:

rotary-driving a developing roller at a lower speed than a rotation speed for forming an image under a standby state;

counting accumulated time where the developing roller is rotary-driven at a low speed under a standby state;

calculating a toner amount to be forcibly consumed based on the accumulated time; and refreshing the toner by forcibly consuming the calculated toner amount.

6. The toner refreshing method for an image forming device according to claim 5, wherein the step of refreshing the toner is executed at a timing of turning on a power supply switch, turning off the power supply switch, returning from a power saving mode, or right before forming an image.

* * * * *